US007089079B2

(12) United States Patent
Kaiya et al.

(10) Patent No.: US 7,089,079 B2
(45) Date of Patent: Aug. 8, 2006

(54) SEWING MACHINE AND COMPUTER PROGRAM

(75) Inventors: Akira Kaiya, Nagoya (JP); Tsuneo Okuyama, Inabe-gun (JP); Norihiko Asai, Kasugai (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 11/195,801

(22) Filed: Aug. 3, 2005

(65) Prior Publication Data

US 2006/0027151 A1 Feb. 9, 2006

(30) Foreign Application Priority Data

Aug. 3, 2004 (JP) ..... 2004-226586

(51) Int. Cl.
*D05B 21/00* (2006.01)

(52) U.S. Cl. ..... 700/136; 112/470.06; 112/102.5

(58) Field of Classification Search ..... 700/138, 700/136, 137; 112/102.5, 470.06, 445, 456, 112/458

See application file for complete search history.

(56) References Cited

U.S. PATENT DOCUMENTS 4,960,061 A * 10/1990 Tajima et al. ..... 112/470.06
5,025,740 A * 6/1991 Horie et al. ..... 112/456
5,156,107 A * 10/1992 Kyuno et al. ..... 112/445
5,791,270 A * 8/1998 Mori ..... 700/138

FOREIGN PATENT DOCUMENTS

JP A-2001-17757 1/2001

* cited by examiner

*Primary Examiner*—Danny Worrell
(74) *Attorney, Agent, or Firm*—Oliff & Berridge, PLC.

(57) ABSTRACT

A sewing machine of the present disclosure is provided with a sewing device capable of pattern sewing by controlling a needle swinging mechanism that swings a vertically reciprocating needle bar in a horizontal direction and a cloth feeding mechanism having a feed dog, a controller that controls the sewing device and a memory that stores sewing data supplied externally via a data transmitting network or a data storage media. The aforementioned controller determines whether or not the pattern to be sewn based on the sewing data loaded from the memory can be sewn by the sewing device and upon determining that sewing is not possible, the sewing data is modified to a pattern that can be sewn by the sewing device.

26 Claims, 13 Drawing Sheets

| | |
|---|---|
| MAXIMUM CLOTH FEED PITCH | 4mm |
| MAXIMUM NEEDLE SWING AMOUNT | 5mm |
| MAXIMUM LATERAL FEED PITCH | 0.5mm |
| MAXIMUM SEWING SPEED | 1000rpm |
| AUTOMATIC THREAD TENSION ADJUSTMENT RANGE | LEVEL 1 TO 9 |
| NUMBER OF DISPLAY PIXELS (VERTICAL × LATERAL) | 320 × 120 (DOTS) |
| GRADATION RANGE OF COLOR DISPLAY | 256 |

FIG. 3

| NUMBER OF TOTAL STITCH DATA | | | |
|---|---|---|---|
| FIRST NEEDLE DROP POINT | F1 | Z1 | S0 |
| SECOND NEEDLE DROP POINT | F2 | Z2 | S0 |
| THIRD NEEDLE DROP POINT | F3 | Z3 | S0 |
| FOURTH NEEDLE DROP POINT | F4 | Z4 | S1 |
| ⋮ | ⋮ | ⋮ | ⋮ |
| NTH NEEDLE DROP POINT | Fn | Zn | S0 |
| THREAD TRIM COMMAND | | | |

FIG. 12

SEWING MACHINE AND COMPUTER PROGRAM

CROSS-REFERENCE TO RELATED APPLICATIONS

This application is based upon and claims the benefit of priority from the prior Japanese Patent Application No. 2004-226586, filed on Aug. 3, 2004 the entire contents of which are incorporated herein by reference.

BACKGROUND

The present disclosure relates to a computer program executed by a computer which composes a sewing machine as well as a controller of the sewing machine. The disclosure is related more particularly to a computer program that fully utilize sewing functions provided in the sewing machine owned by the user so that sewing patterns for practical use such as utility patterns and decorative patterns not categorized as embroidery patterns, which were acquired via a data transmitting network or a data storage media can be utilized to a maximum extent.

Conventional household electronic embroidery sewing machines are capable of sewing patterns for practical use such as zigzag stitches, straight stitches and decorative stitches and the like. Additionally, an embroidery frame moving device that moves the embroidery frame independently in two mutually perpendicular directions is detachably attached to a bed of the electronic sewing machine which enables embroidery sewing by using the embroidery frame moving device.

That is, in case of sewing a practical pattern, in other words, upon normal sewing, the pattern is formed by moving a cloth to front-rear and left-right directions by a feed dog provided in the bed of the sewing machine, while vertically driving and laterally swinging a needle bar, without using the embroidery frame moving device. Also, in case of sewing the embroidery pattern, in other words, upon embroidery sewing, the embroidery frame moving device is attached to the sewing machine bed and an embroidery pattern can be formed on the cloth retained by the embroidery frame by driving the embroidery frame moving device based on sewing data of the desired pattern and moving the embroidery frame while vertically driving the needle bar.

In a recent electronic embroidery sewing machine, a connector for a ROM card, which is an external memory, and a disk drive for a flexible disk (FD media) are provided. The user, by purchasing ROM cards and flexible disks available in the market, can load various pattern data stored in the ROM cards and flexible disks to the electronic sewing machine. The sewing machine is arranged to be capable of sewing various patterns other than the patterns pre-stored therein. (For example, refer disclosure Japan Patent Number 2001-17757 pages 5 to 6 and FIG. 2).

In the embroidery sewing machine described in the above disclosure, the user is required to selectively purchase only the ROM cards and flexible disks storing sewing data which can be sewn by the functions provided in the sewing machine and display data which can be displayed in the display. Hence, various sewing patterns stored in the purchased ROM cards can be easily and neatly sewn by the sewing machine.

Recently, illustrations, character patterns, decorative patterns and sewing data for various normal sewing patterns to be used in electronic sewing machines are distributed over the internet, which is a data communication network. Hence, the user can easily acquire desired sewing data for normal sewing patterns via a personal computer and the electronic sewing machine is capable of sewing the patterns based on the acquired sewing data.

In such case, even if the sewing data distributed over the internet is adaptable for general use by the latest types of electronic sewing machines, depending upon the electronic sewing machine owned by each user, some may have basic sewing functions such as maximum cloth feed pitch of the feed dog and a maximum needle swing amount by a needle bar swing, etc. that differ from the latest type of electronic sewing machines and some may not be provided with optional functions such as an automatic thread tension adjustment function etc.

For example, suppose the user finds desirable patterns in pattern exhibits of various internet sites, however the sewing data of the patterns include basic function data or optional function data which require functions that are not provided in the user's sewing machine. In such case, the user, willing to sew these patterns despite the need to more or less transform the patterns, had to give up sewing of the acquired patterns since the deviation from the specifications of the user's sewing machine will result in an error processing by a sewing control.

SUMMARY

The purpose of the disclosure is to provide a computer program executed by a computer which is a component of a sewing machine and a controller of the sewing machine that enables the sewing of sewing data acquired externally via data transmitting network and data storage media to a possible extent, even if the acquired sewing data cannot be sewn owning to a lack of sewing functions provided in the sewing machine, by modifying the acquired sewing data.

The sewing machine of the disclosure is provided with a sewing device capable of sewing a pattern by controlling a needle swinging mechanism that swings a vertically reciprocating needle bar in a horizontal direction, a cloth feeding mechanism having a feed dog, a controller that controls the sewing device and a memory that stores sewing data supplied externally via a data transmitting network or a data storage media. The controller is characterized by a capability to determine whether or not the pattern to be sewn based on the sewing data loaded from the memory can be sewn by the sewing device. Upon determining that sewing is not possible, the sewing data is modified to a pattern that can be sewn by the sewing device.

With this configuration, even if some of the externally supplied data cannot be sewn by the functions originally provided in the sewing device of the sewing machine owning to the existence of function data that realize various sewing functions, such sewing data can be modified to data that can be sewn within the capacity of the functions of the sewing device and enable the sewing by the sewing machine.

Also, the sewing machine of the disclosure is provided with a sewing device capable of sewing a pattern by controlling a needle swinging mechanism that swings a vertically reciprocating needle bar in a horizontal direction and a cloth feeding mechanism having a feed dog, a controller that controls the sewing device and a memory that stores sewing data supplied externally via a data transmitting network or a data storage media. The controller is characterized by a capability to determine whether or not the pattern to be sewn based on a pattern display data loaded from the memory can be displayed in the display or not.

Upon determining that displaying is not possible, the pattern display data is modified to a pattern that can be displayed by the display.

Such configuration enables the display of the pattern display data to the display since the pattern display data is modified to data that can be displayed even if the externally supplied pattern display data cannot be displayed by the display originally provided in the sewing machine.

Also, the sewing machine of the disclosure is provided with a sewing device capable of sewing a pattern by controlling a needle swinging mechanism that swings a vertically reciprocating needle bar in a horizontal direction, a cloth feeding mechanism having a feed dog and a controller that controls the sewing device. The sewing machine is further provided with a memory that stores sewing data, which is supplied externally via a data transmitting network or a data storage media including at least data that control the needle swinging mechanism and/or the cloth feeding mechanism used for controlling the sewing device. The controller, in case the sewing data loaded from the memory includes data unusable by the sewing device, invalidates the unusable data.

Such configuration enables a partial invalidation of the sewing data instead of treating the entire sewing data as unusable data. Thus, valid portions of the sewing data can be used to the possible extent.

BRIEF DESCRIPTION OF THE DRAWINGS

Other objects, features and advantages of the present disclosure will become clear upon reviewing the following description of the embodiment with reference to the accompanying drawings, in which:

FIG. 3 is a table showing a sewing function and display function stored in a function setting memory;

FIG. 12 is a descriptive figure that describes a data configuration of the sewing data;

EMBODIMENT EXAMPLES OF THE DISCLOSURE

The first embodiment of the present disclosure is described hereinafter with reference to the drawings.

Figure 1:
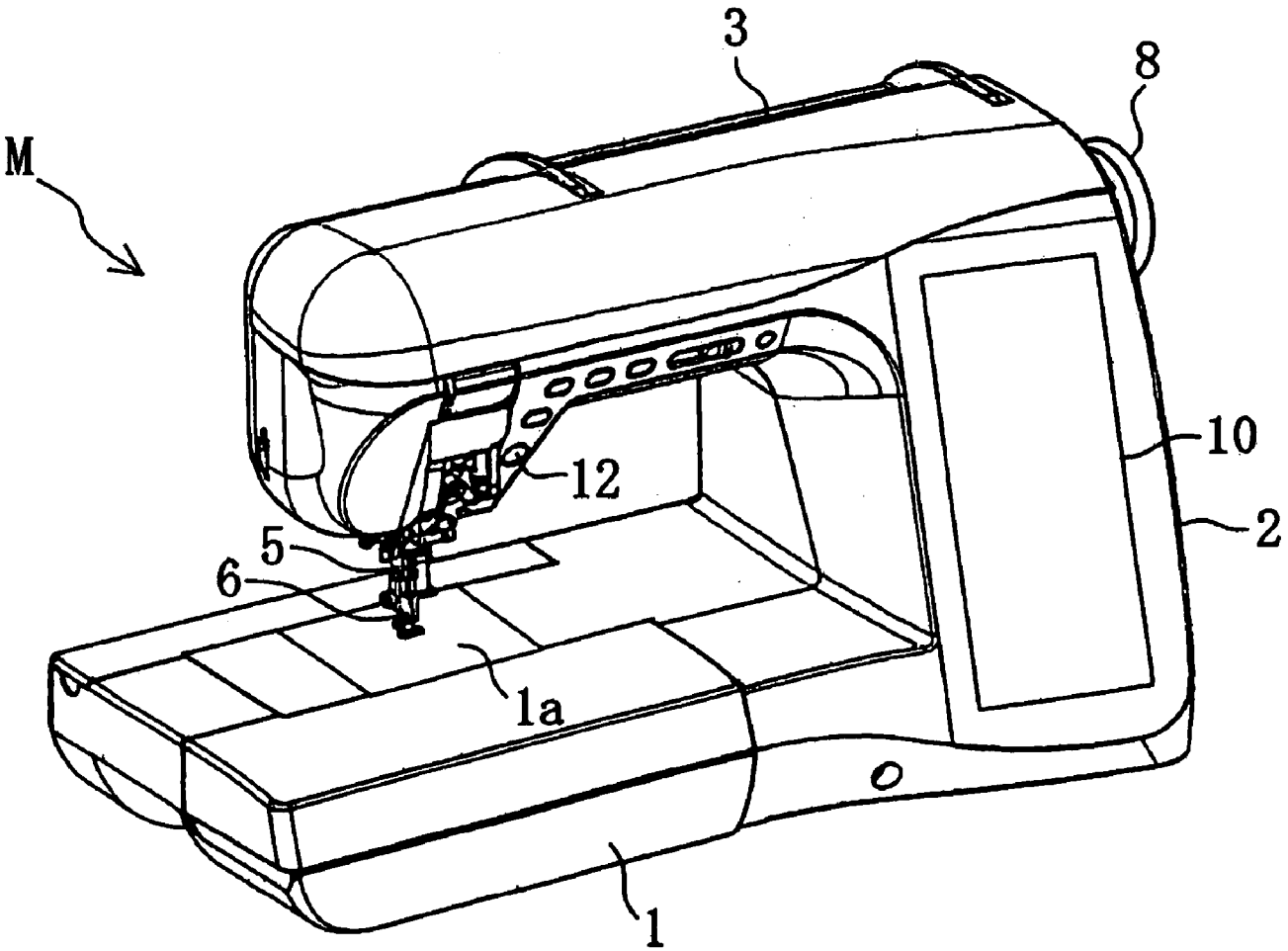
FIG. 1 is a perspective view of an electronically controlled sewing machine in accordance with an embodiment example of the present disclosure.

First, an electronically controlled sewing machine M (hereinafter simply referred to as sewing machine) will be briefly described. As shown in FIG. 1, the sewing machine M is an ordinary household sewing machine controlled electronically and is provided with a bed 1, a pillar 2 standing upright from a right end of the bed 1 and an arm 3 extending leftward over the bed 1 from an upper end of the pillar 2.

Below a needle plate la of the bed 1, in addition to a feed dog vertically moving mechanism and a feed dog longitudinally moving mechanism, a lateral feeding mechanism that moves the feed dog in a lateral direction, a rotary hook that accommodates a bobbin and moves co-operatively with a sewing needle 6 and a thread trimming mechanism (neither of which are shown) are provided.

A large type color liquid crystal display (hereinafter simply referred to as display) 10 is provided on the front surface of the pillar 2. The display 10 displays sewing patterns of normal sewing patterns, function names required for performing sewing work and furthermore, various types of messages etc. The sewing machine M, by combining a cloth feed and needle swing, is capable of sewing not only utility patterns such as straight stitching, zigzag stitching but also, character patterns, decorative patterns and various types of normal sewing patterns. Such patterns including utility patterns, character patterns and decorative patterns are all together referred to as normal sewing patterns hereinafter.

Figure 2:
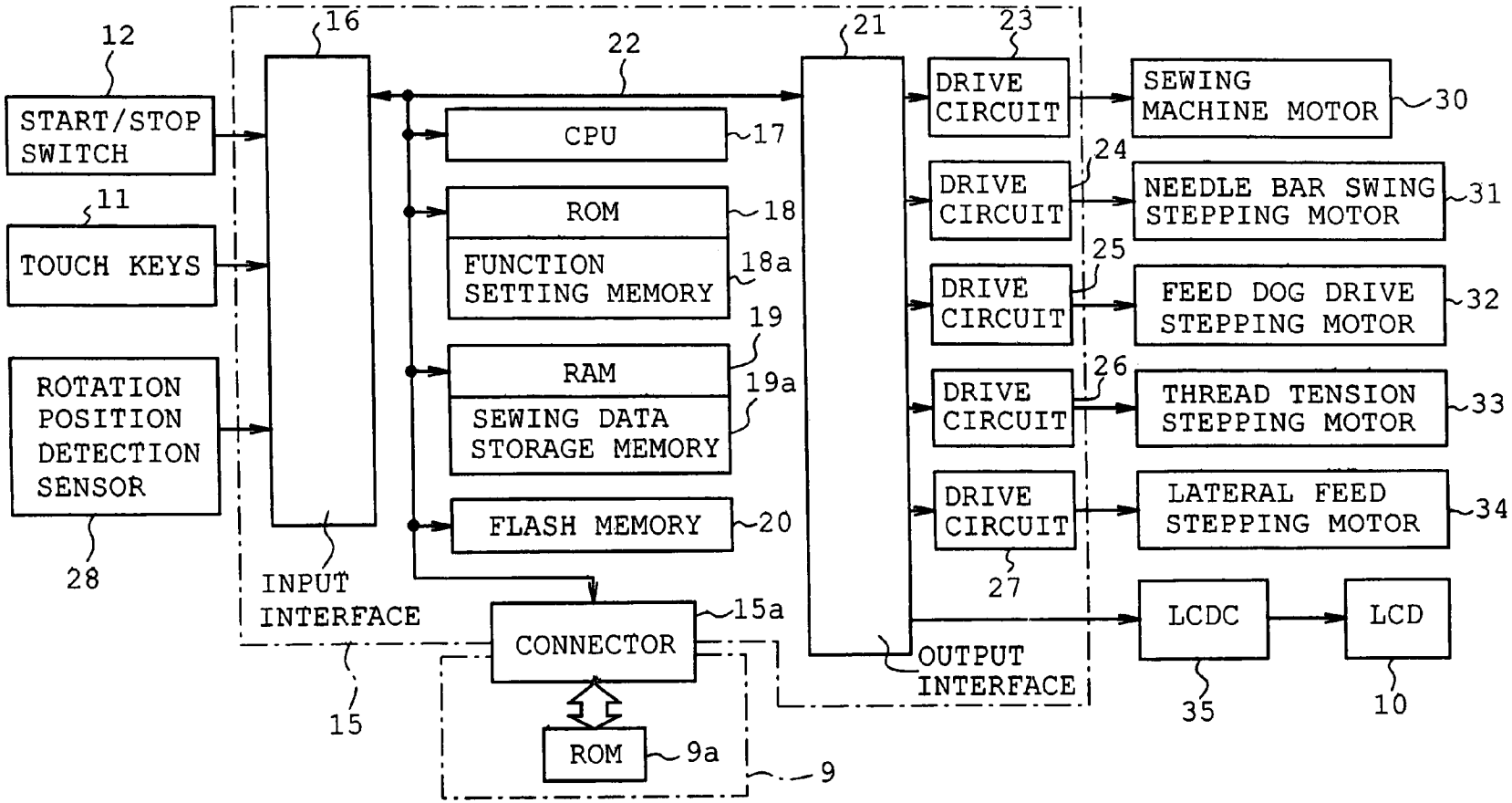
FIG. 2 is a block diagram of a control system of the electronically controlled sewing machine.

A connector 15*a* for attaching a ROM card 9 (this corresponds to a storage media) which is an external storage memory, is provided on the side of the pillar 2 (refer to FIG. 2). Various types of pattern display data of normal sewing patterns are mated with pattern numbers and stored in a ROM9*a* of the ROM card 9.

An operation panel having touch keys 11 composed of transparent poles are provided on a front surface of the display 10. The touch keys 11 are arranged to mate with display positions for numerical settings etc., such as plurality of names of normal sewing patterns, function names, feed amount, needle swinging amount and the like in each type of setting screen. Therefore, the user can select the patterns to be sewn, instruct execution of functions and set numerical values by pressing the touch keys 11 corresponding to pattern display sections and setting sections displayed in each setting screen.

In the arm 3, a laterally extending sewing machine main shaft (not shown), a hand pulley 8 enabling the operator to manually rotate the sewing machine main shaft, a needle bar driving mechanism that vertically moves a needle bar 5 with a sewing needle attached in a lower end, a needle swinging mechanism that swings the needle bar 5 in a direction perpendicular to a cloth feeding direction, and a thread take-up driving mechanism that vertically moves a thread take-up in synchronization with the needle bar 5 (neither of which are shown) are provided. The sewing machine main shaft is rotationally driven by a sewing machine motor 30 described in FIG. 2.

On the arm 3, a thread tensioner having a pair of thread tensioning disks and an automatic thread tension adjustment mechanism (neither of which are shown) are provided. The automatic thread tension adjustment mechanism enables the adjustment of thread tension of the pair of thread tension disks in the range of level 1 to 9 as shown in FIG. 3, wherein level 9 has the largest tension. The automatic thread tension adjustment mechanism is driven by the thread tension stepping motor 33 (refer to FIG. 2).

A sewing start/stop switch 12 that instructs the start and stop of a sewing process is provided along with other switches on the front surface of the arm 3. The feed dog vertically moving mechanism and needle bar vertically moving mechanism are driven by the sewing machine motor 30, however, a needle bar swinging mechanism that swings the needle bar is driven by a needle bar swing stepping motor 31 (refer to FIG. 2). Also, the feed dog longitudinally moving mechanism that drives the feed dog in the longitudinal direction is driven by a feed dog longitudinally driving stepping motor 32 (refer to FIG. 2) and a lateral feeding mechanism is driven by a lateral feed stepping motor 34 (refer to FIG. 2).

Next, a control system of the sewing machine M is described. As shown in FIG. 2, a control device 15 (this corresponds to a controller) has an input interface 16, a computer including a CPU 17, a ROM 18, a RAM 19 and an electronically rewritable and nonvolatile flash memory 20, an output interface 21, a bus 22 such as a data bus that interconnects the foregoing and drive circuits 23 to 27 and the like.

The start/stop switch 12, an operation panel 11 having touch keys and a rotation position detection sensor 28 detecting a rotation position of the sewing machine main shaft etc. are connected to the input interface 16. Drive circuits 23 to 27 that drives the motors 30 to 34 and a display controller (LCDC) 35 and the like that controls the display (LCD) are connected to the output interface 21.

A Sewing control program including a pattern selection control which selects utility patterns, and various display controls; and control programs for data processing control of normal sewing patterns which are specific to the disclosure etc.; control various driving mechanisms as well as being pre-stored in the ROM 18. Further, as shown in FIG. 3, the following information is stored in a function setting memory 18*a* of the ROM 18: a sewing function information of a sewing function executed for sewing the normal sewing patterns with sewing machine M; and a display function information(the so called specifications) for displaying the patterns.

Next, the sewing function information is briefly described. As shown in FIG. 3, in the sewing machine M, the following information is preset: a maximum cloth feed pitch "4 mm"; a maximum needle swing amount of the needle bar 5 "5 mm"; a maximum lateral feed pitch executed in a single feed operation "0.5 mm"; a maximum sewing speed by the sewing machine motor 30 "1000 rpm"; an automatic thread tension adjustment range "level 1 to 9"; a number of display pixels provided as a pattern display area of the display 10 "320×120 dots"; and a gradation range of color display "256".

The following are provided in the RAM 19 on a required basis: a sewing data storage memory 19*a* (corresponding to sewing memory) that stores the sewing data supplied externally; various memory areas that accommodate the calculation results of the calculation process of the CPU 17, a pointer area and a software counter area etc.

Next, a data processing control routine for the normal sewing patterns executed by the control device 15 is described based on flowcharts in FIGS. 4 to 9. The symbols Si (i=11, 12, 13 . . . ) in the figures indicate each step.

Figure 4:
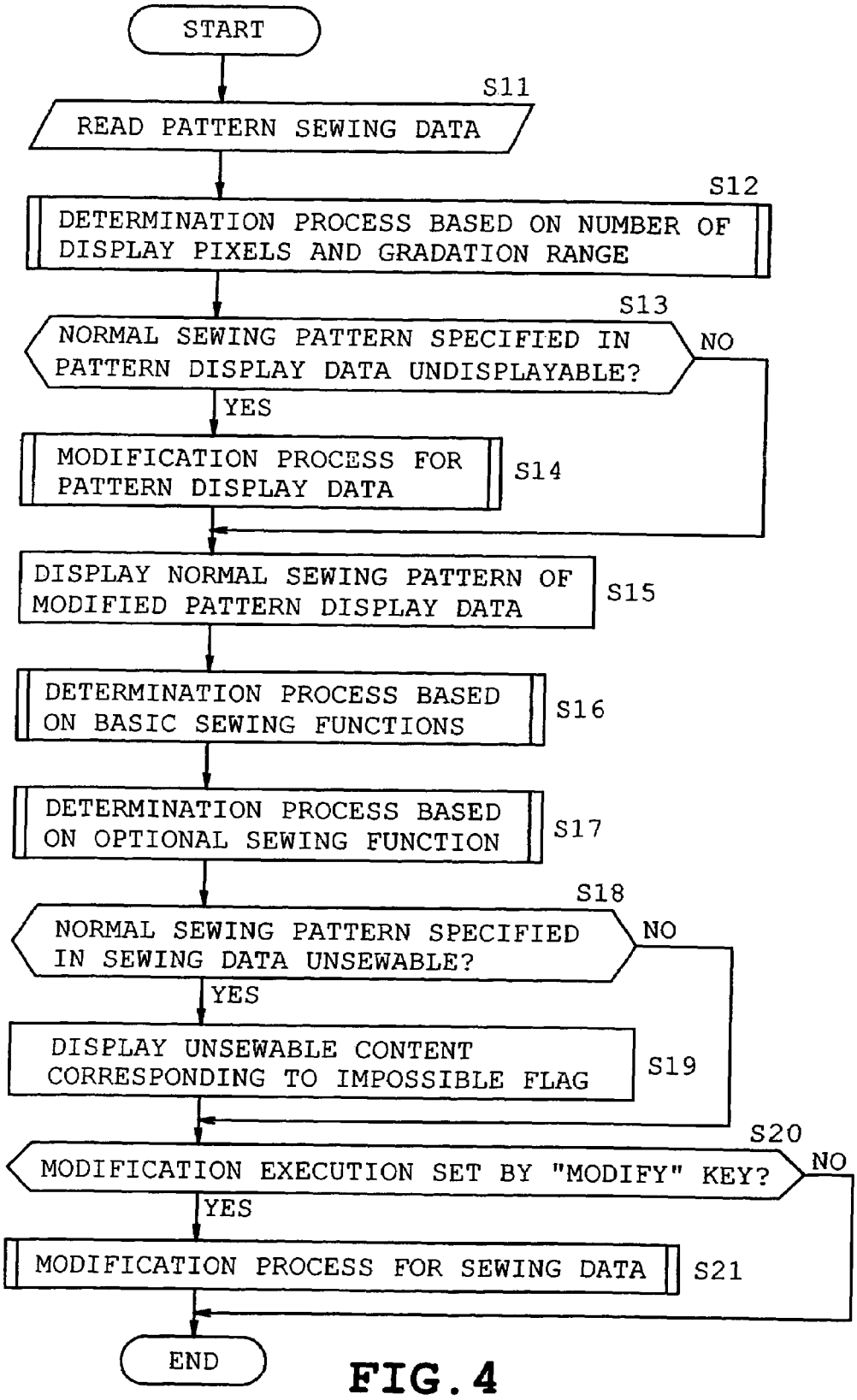
FIG. 4 is a flow chart of a data modification control for a normal sewing pattern.
Figure 5:
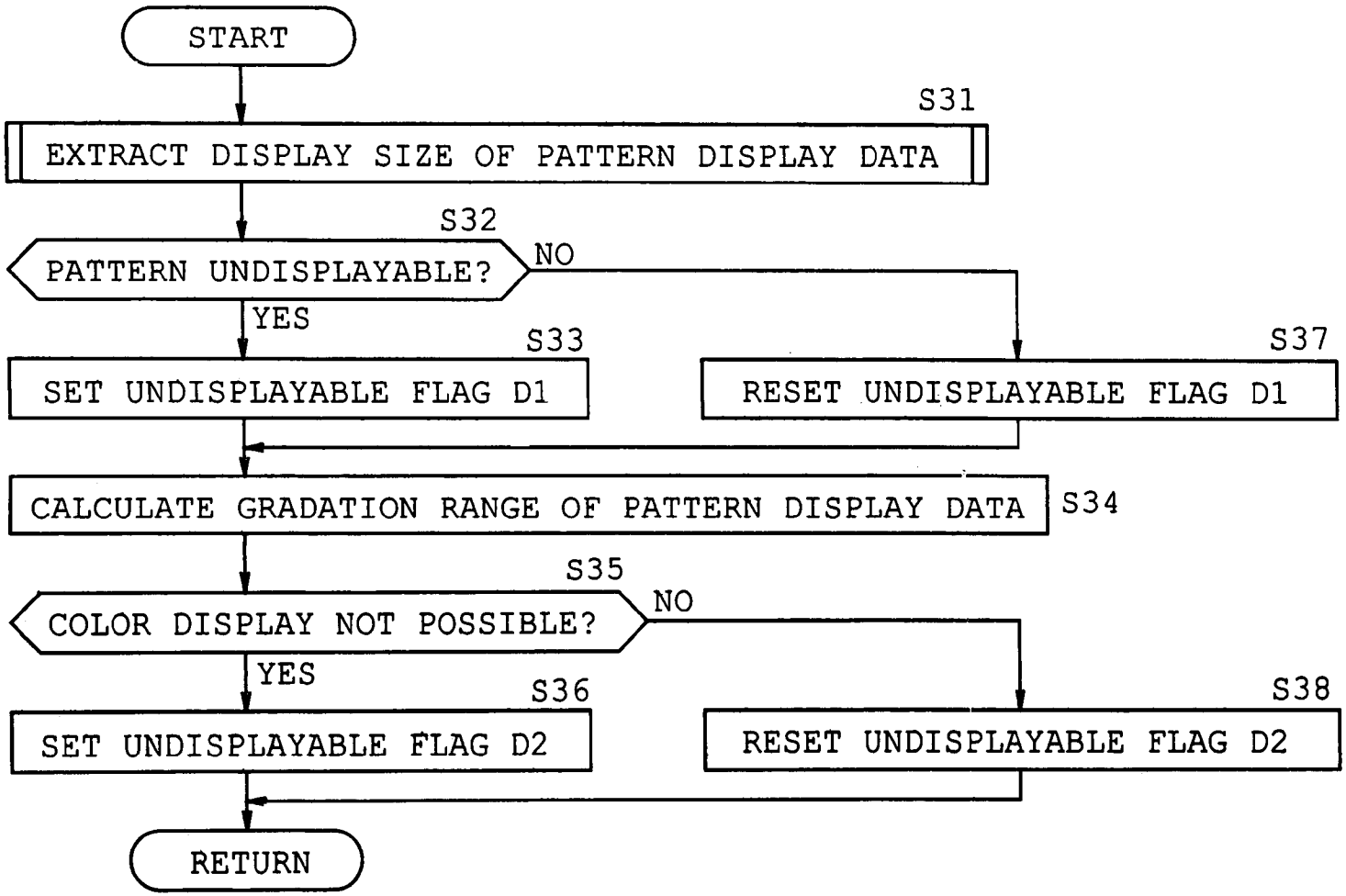
FIG. 5 is a flow chart of a determination process control based on a number of display pixels and a gradation range.

When one of a plurality of the normal sewing patterns stored in the ROM card 9 is selected by operating the touch keys 11 via a pattern selection screen of the display 10, the control shown in FIG. 4 is started by the CPU 17 of the control device 15. First, a pattern sewing data (inclusive of the pattern display data and sewing data) of the selected normal sewing pattern is loaded from the ROM card 9 and stored in the sewing data storage memory 19*a* of the RAM 19 (S11) by the CPU 17.

Figure 10:
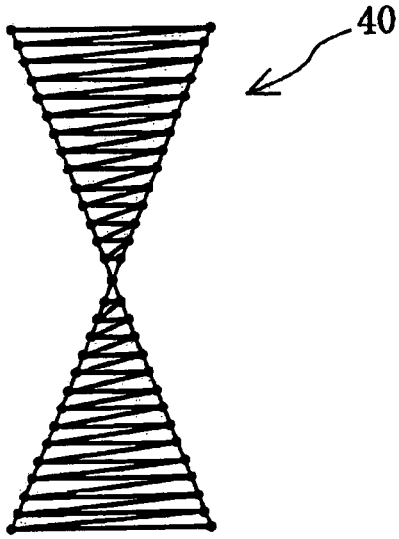
FIG. 10 is a figure showing the normal sewing pattern (decorative pattern) loaded in the sewing machine.
Figure 11:
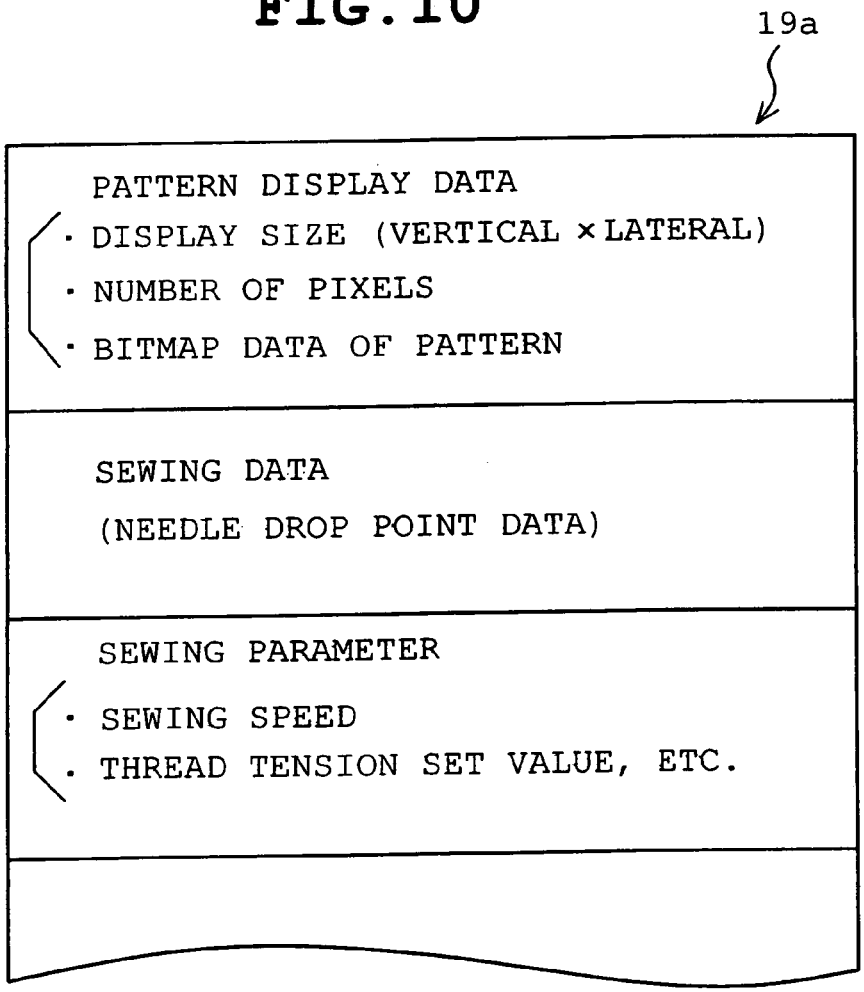
FIG. 11 is a descriptive figure that describes a data configuration of pattern sewing data for the normal sewing pattern.

For example, the pattern sewing data of the normal sewing pattern (decorative pattern) 40 shown in FIG. 10, generally includes for example, the pattern display data, the sewing data and sewing parameters etc. as shown in FIG. 11. In this case, as the pattern display data, display size (number of dots in the vertical direction×number of dots in the lateral direction), total number of pixels, a bit map data that displays the patterns etc. are provided.

As shown in FIG. 12, the sewing data includes in addition to a total number of stitches, cloth feed pitch data F, needle swing data Z and lateral feed data S corresponding to each needle drop point (a first needle drop point, a second needle drop point, a third needle drop point, . . . and nth needle drop point). However, lateral feed data S0 is the data indicating the absence of execution instruction of lateral feed and lateral feed data S1 is the data indicating the execution instruction.

Next, a determination process (refer to FIG. 5) is executed (S12) with respect to the pattern display data included in the pattern sewing data by the CPU 17, based on the number of color display pixels and gradation range of color display possessed by the display 10. When this control is started, first, the display size (number of display dots in the vertical direction×number of display dots in the lateral direction) included in the loaded pattern display data is extracted, however, in case the data is compressed, a decompression process is performed (S31).

Next the display size and the display pixels are compared. If the pattern display is not possible (S32: Yes) because a length direction of the pattern display area of the normal sewing pattern (vertical length or lateral length) and the length direction of the pattern display area of the display 10 do not match, an undisplayable flag D1 is set (S33). On the other hand, in case the length direction of the pattern display area of the normal sewing pattern 40 and the length direction of the pattern display area of the display 10 do match and the pattern display in the display direction is possible (S32: No), the undisplayable flag D1 is reset (S37).

Next, the gradation range (number of colors) of the pattern display data is calculated (S34) based on the number of image configuration dots of color display by R, G and B included in each dot data of the bit map data of the pattern. For example, the gradation range in case of an 8 bit image configuration is "256 gradations".

Next, the gradation range of the pattern display data and the gradation range of color display are compared. If gradation range of the pattern display data is greater than the gradation range of color display and color display is not possible (S35: Yes), an undisplayable flag D2 is set (S36): On the other hand, if gradation range of the pattern display data is equal to or less than the gradation range of color display and color display is possible (S35: No), the undisplayable flag D2 is reset (S38). Then, this control is terminated and the control returns to a data processing control of the normal sewing pattern 40.

Figure 6:
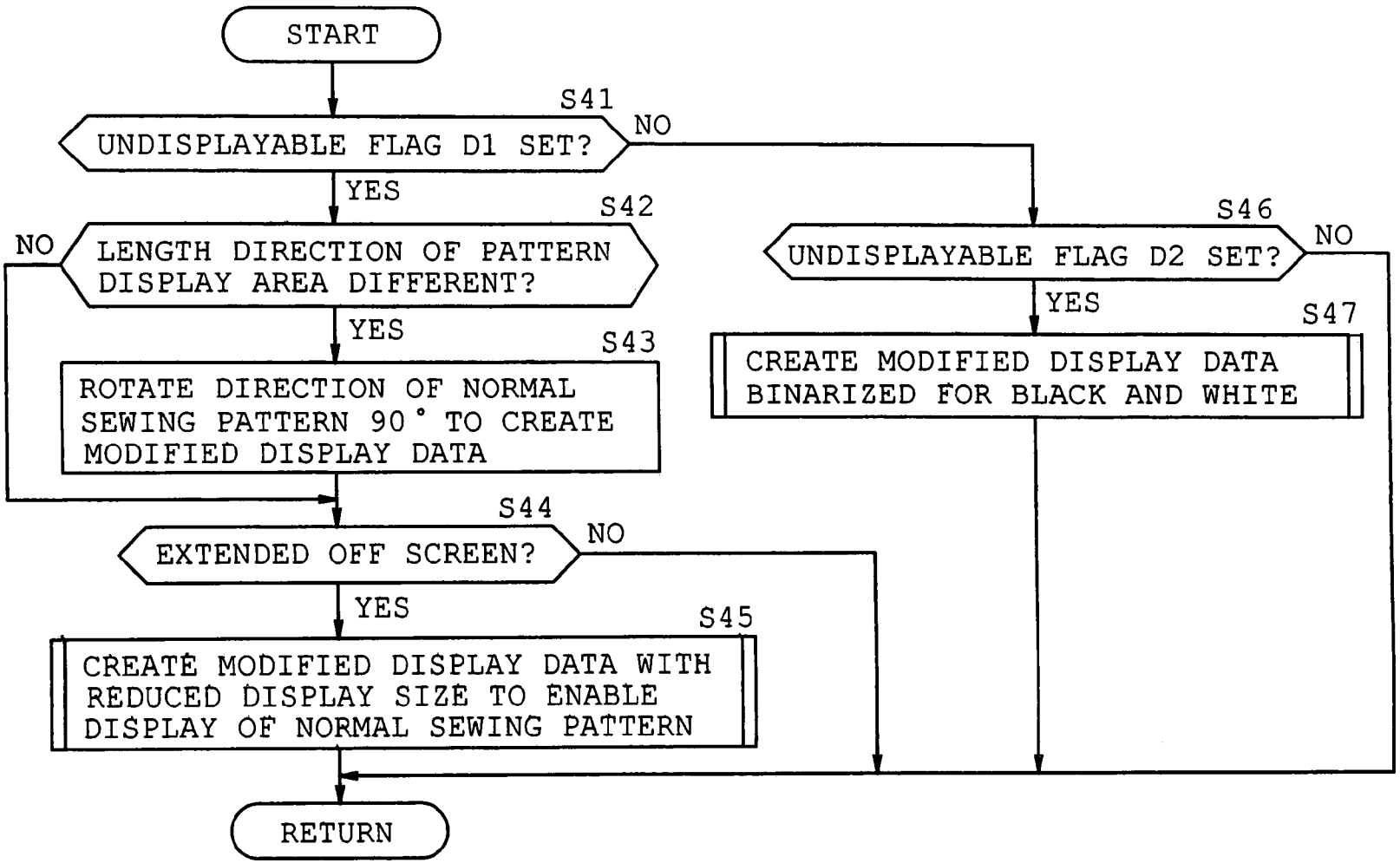
FIG. 6 is a flow chart of a modification process control for pattern display data.
Figure 7:
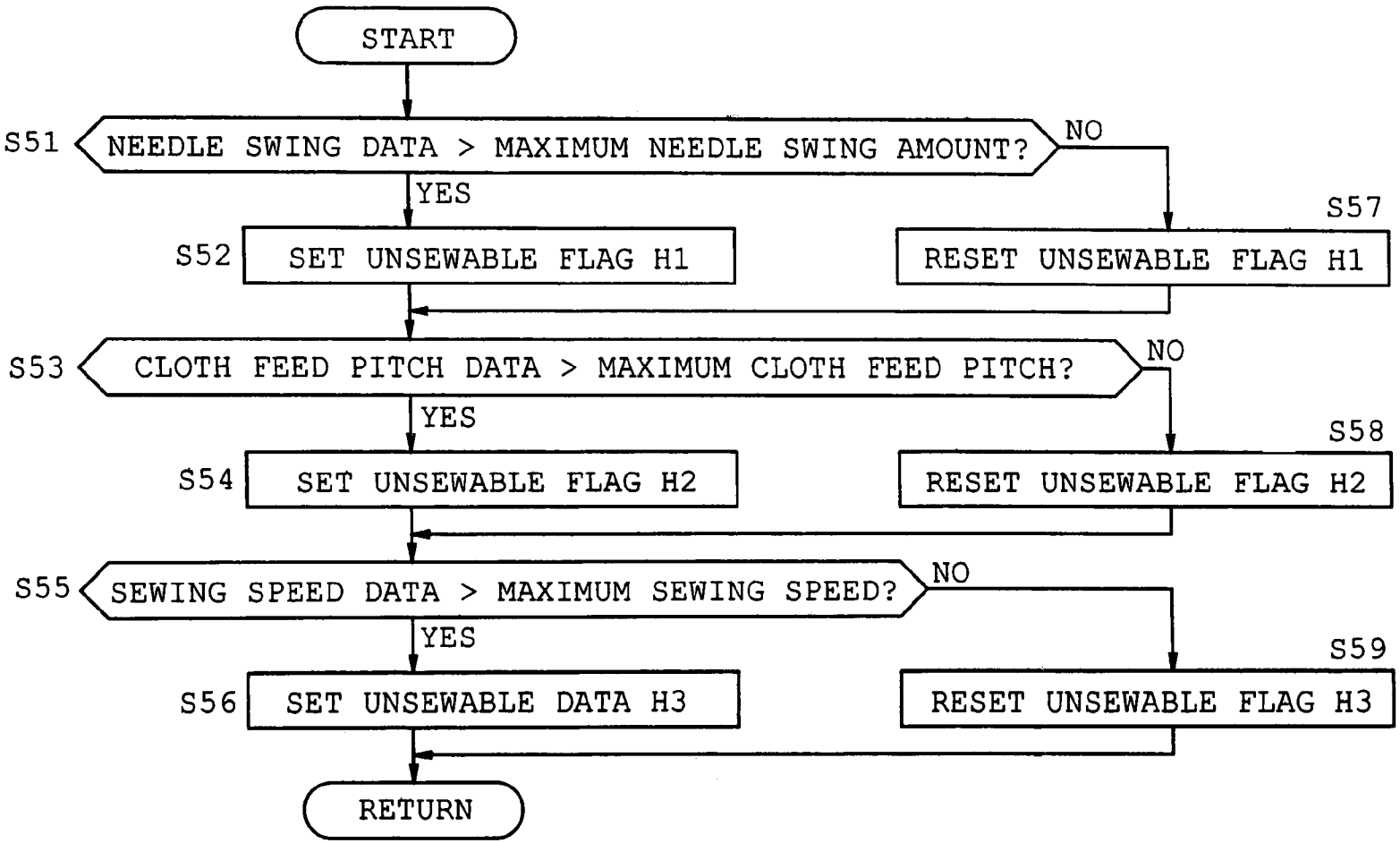
FIG. 7 is a flow chart of a determination process control related to basic sewing functions.
Figure 8:
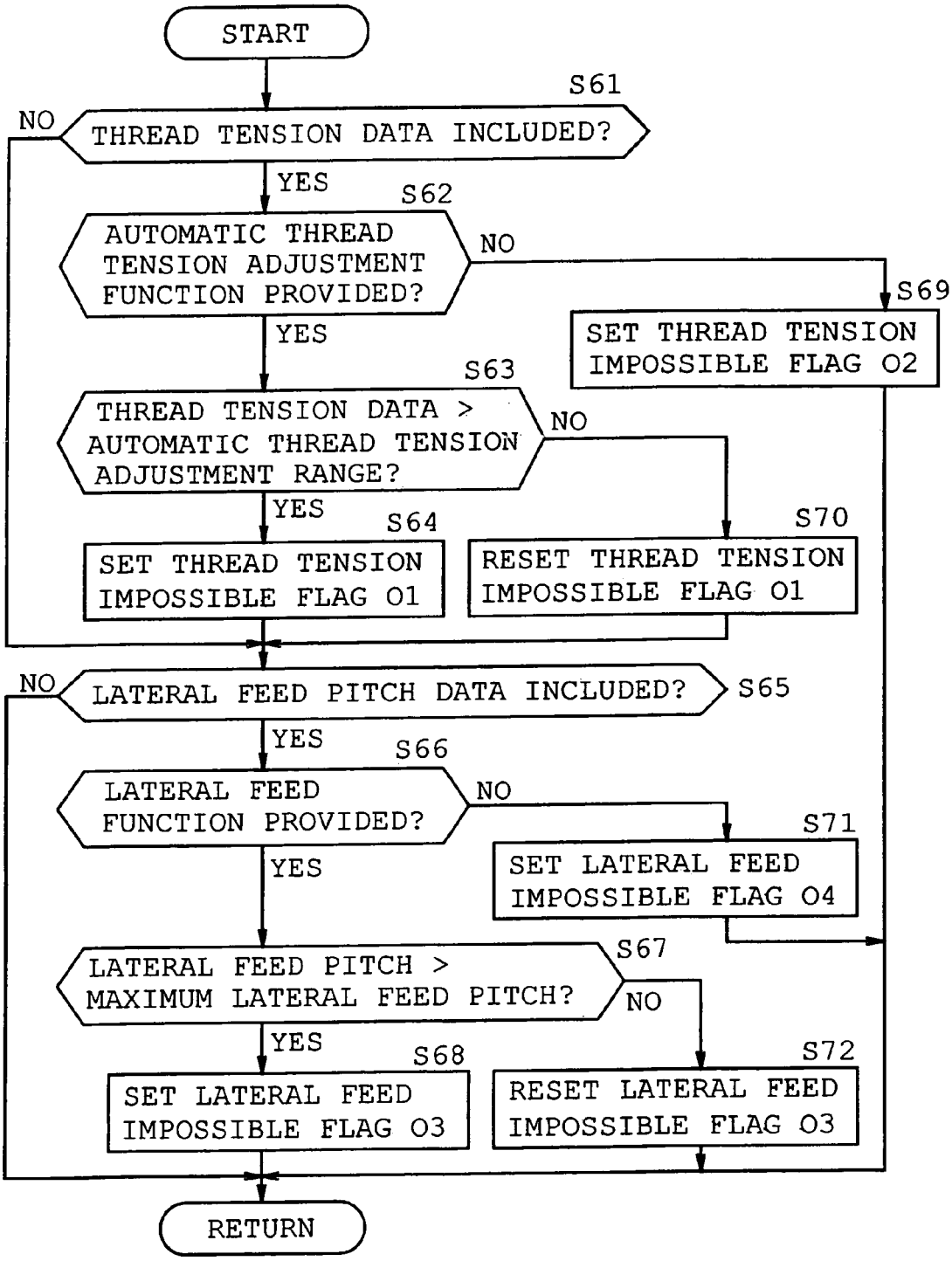
FIG. 8 is a flow chart of a determination process control related to optional sewing functions.
Figure 9:
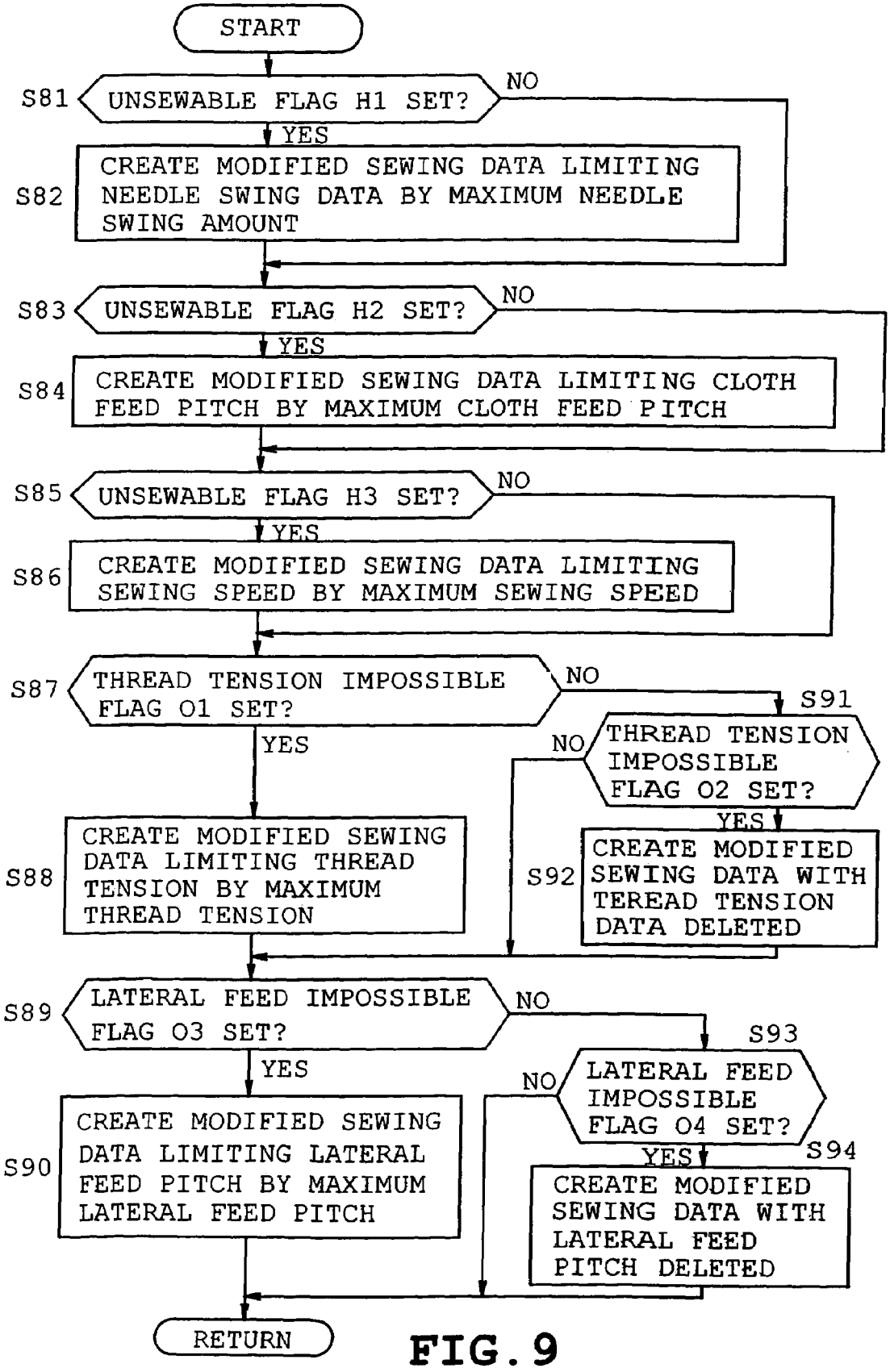
FIG. 9 is a flow chart of the modification process control for sewing data.

Next, if either one of the undisplayable flag D1 or D2 is set in the data processing control of the normal sewing pattern 40 and the normal sewing pattern 40 specified by the pattern display data is not displayable (S13: Yes), a modification process (refer to FIG. 6) of the pattern display data is executed by the CPU 17 (S14). Referring to FIG. 6, first, in case undisplayable flag D1 is set (S41: Yes), and the length direction of the pattern display area of the normal sewing pattern 40 and display 10 do not match (S42: Yes), a modified display data which is a 90° rotation of the direction of the normal sewing pattern 40 is created (S43).

Next, even in case the length direction of the pattern display area of the normal sewing pattern 40 and display 10 do match, if either one of the vertical direction or lateral direction of the pattern display area of the former is greater than either one of the vertical direction or lateral direction of the pattern display area of the latter; and the former pattern extends off the display area of the latter (S44: Yes), a reduction ratio corresponding to the amount of extension is calculated. Then, a modified display data having reduced display size that enables the display of the normal sewing pattern 40 is created (S45) based on the reduction ratio. Finally, this control is terminated, and the control returns to the data processing control of the normal sewing pattern.

On the other hand, in case the undisplayable flag D2 is set and if the gradation range of the pattern display data is greater than the gradation range of color display (S46:Yes), the normal sewing pattern 40 cannot be displayed in full color. In this case, a modified display data binarized for black and white display is created (S47) and the control similarly returns to the data processing control of normal sewing pattern. In case the color image is binarized, various image processing methods can be used such as an average density approximation method etc. which uses a predetermined threshold value.

Figure 13:
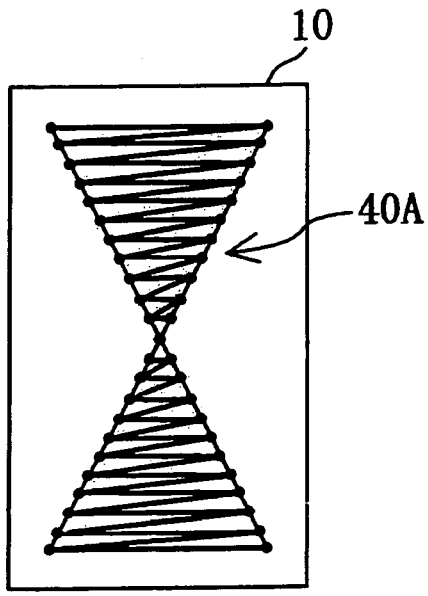
FIG. 13 is a figure showing a display sample of the normal sewing pattern displayed to a display.

Next, in the data processing control of the normal sewing pattern, the normal sewing pattern 40 specified by the modified pattern display data is displayed to the display 10 (S15). For example, in case the vertical direction and the lateral direction of the normal display area match in the normal sewing pattern 40 and the display 10, if the latter is equal to or greater than the former with respect to the lateral direction dimension, however if the display 10 is less with respect to the vertical direction dimension, as shown in FIG. 13, a normal sewing pattern 40A with reduced vertical direction dimension is displayed to the display 10.

Next, a determination process (refer to FIG. 7) related to the basic sewing function is executed for the sewing data included in the pattern sewing data (S16). When this control is started, first, a needle swing data for each and every needle drop point included in the sewing data is searched and in case any needle swing data is greater than the maximum needle swing amount related to basic functions of the sewing machine M (S51: Yes), an unsewable flag H1 is set (S52). However, if every needle swing data is equal to or less than the maximum needle swing amount, (S51: No), the unsewable flag H1 is reset (S57).

Next, the cloth feed pitch data is searched for each and every needle drop point included in the sewing data and in case any one of the cloth feed pitch data is greater than the maximum cloth feed pitch related to the basic functions of the sewing machine M (S53; Yes), an unsewable flag H2 is set (S54). On the other hand, in case every one of the cloth feed pitch data is equal to or less than the maximum cloth feed pitch (S53: No), the unsewable flag H2 is reset (S58).

Next, a sewing speed data included in the sewing parameter is searched, and in case the sewing speed data is greater than a maximum sewing speed related to the basic functions of sewing machine M (S55: Yes), an unsewable flag H3 is set (S56). On the other hand, in case the specified sewing speed data is equal to or less than the maximum sewing speed (S55: No), the unsewable flag H3 is reset (S59). Then, the control is terminated and the control returns to the data processing control of the normal sewing pattern.

Next, in the data processing control of the normal sewing pattern, a determination process (refer to FIG. 8) for the optional functions is executed with respect to the sewing data (S17). When this control is started, first, the thread tension data included in the sewing data is searched, and in case the thread tension data is included in the sewing data (S61: Yes) and if sewing machine M is provided with the automatic thread tension adjustment mechanism (S62: Yes), furthermore, if the thread tension data is greater than the automatic thread adjustment range (S63: Yes), a thread tension impossible flag O1 is set (S64).

On the other hand, in case the sewing machine M is not provided with the automatic thread tension adjustment mechanism (S62: No), a thread tension impossible flag O2 is set (S69) and this control is terminated. Also, if the thread tension data is equal to or less than the automatic thread tension adjustment range, that is, in case the thread tension data is within the range of the automatic thread tension adjustment range of the sewing machine M (S63: No), the thread tension impossible flag O1 is reset (S70).

Next, the lateral feed pitch data included in the sewing data is searched. In case the lateral feed data is included in the sewing data (S65: Yes), and the sewing machine M is provided with the lateral feeding mechanism (S66: Yes); furthermore, in case the lateral feed pitch data is greater than the maximum lateral feed pitch (S67: Yes), a lateral feed impossible flag O3 is set. Then the control returns to the data processing control of normal sewing pattern (S68).

On the other hand, in case the sewing machine M is not provided with the lateral feeding mechanism (S66: No), a lateral feed impossible flag O4 is set (S71). Then this control is terminated and the control is returned. Also, in case the lateral feed pitch data is equal to or less than the maximum lateral feed pitch (S67: No), the lateral feed impossible flag O3 is reset (S72).

Next, in the data processing control of the normal sewing pattern, in case either one of the impossible flags O1 to O4 is set, and the normal sewing pattern 40 specified in the sewing data can not be sewn (S18: Yes); based on the impossible flags O1 to O4 which were set, an error message indicating that sewing is not possible is displayed to the display 10 (S19).

For example, in case the thread tension impossible flag O1 or O2 is set, an error message "automatic thread tension adjustment function cannot be executed" is displayed to the display 10 and in case the lateral feed impossible flag O3 or O4 is set, an error message "lateral feed function cannot be executed" is displayed to the display 10.

In case the foregoing error messages are displayed to the display 10, if the user sees the message and still is willing to carry out the sewing work by modifying the sewing data, the user is to operate a "modify" function key provided in the touch keys 11. Then, the execution of data modification is set (S20: Yes) by the CPU 17 and a modification process (refer to FIG. 9) of the sewing data later described is executed (S21) and this process is terminated.

In case the modification process control of the sewing data is started and if the unsewable flag H1 is set (S81: Yes), with respect to the needle swing data among the needle swing data of each needle drop point which exceeds the maximum needle swing amount of the sewing machine M; a modified sewing data limited by the maximum needle swing amount is created (S82). Next, in case the unsewable flag H2 is set (SB3: Yes), with respect to the cloth feed data exceeding the maximum cloth feed pitch among the cloth feed pitch data of each needle drop point; a modified sewing data limited by the maximum cloth feed pitch is created (S84).

Next, in case the unsewable flag H3 is set (S85: Yes), a modified sewing data limiting the specified sewing speed to the maximum sewing speed of the sewing machine M is created (S86). On the other hand, in case the thread tension impossible flag O1 is set (S87: Yes), with respect to the thread tension value exceeding the maximum thread tension value, a modified sewing data limited by the set maximum thread tension is created (S88).

On the other hand, in case the thread tension impossible flag O2 is set (S91: Yes), the realization of automatic thread tension is not possible; hence a sewing data modified to delete every thread tension data is created (S92). Next, in case the lateral feed impossible flag O3 is set (S89: Yes), a modified sewing data limiting the lateral feed pitch by the maximum lateral feed pitch is created (S90) and the control returns to the data processing control of the normal sewing pattern.

On the other hand, in case the lateral feed impossible flag O4 is set (S93: Yes), since the realization of lateral feed function is not possible, a sewing data modified to delete every lateral feed pitch data is created (S94) and the control is returned as described above.

Figure 14:
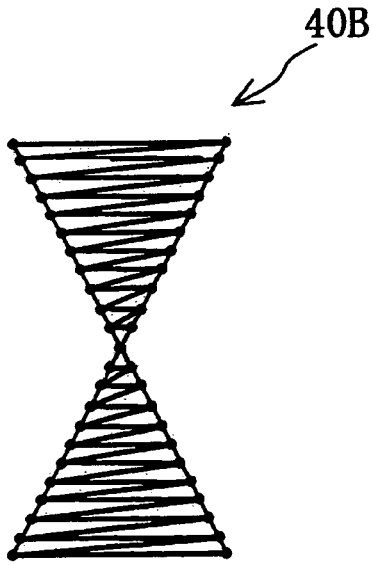
FIG. 14 is a descriptive figure of the normal sewing pattern in which a cloth feed pitch of the sewing data is limited by a maximum cloth feed pitch.

Next, the operation of data processing for the normal sewing pattern configured in such manner is described. First, in case most of the feed pitches in the needle drop points of the sewing data is greater than the maximum cloth feed pitch; for example, as shown in FIG. 14, since every cloth feed pitch is limited to the maximum cloth feed pitch of the sewing machine M, the vertical direction of the normal sewing pattern 40B is shortened. However, sewing of the sewing data, which otherwise could not have been sewn by the sewing machine M, is enabled by the modification.

Figure 15:
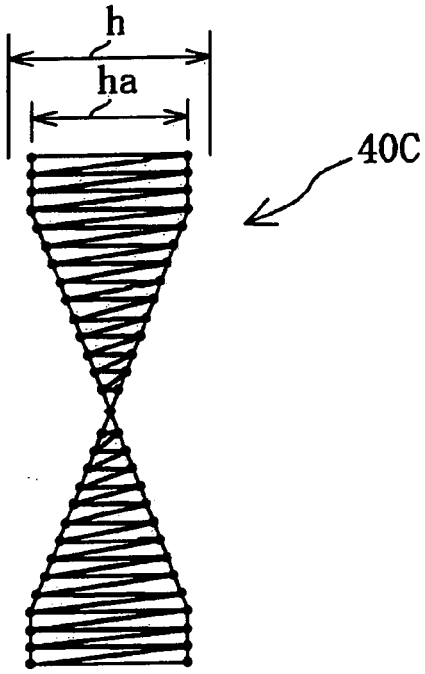
FIG. 15 is a descriptive figure of the normal sewing pattern, in which a needle swing amount of the sewing data of is limited by a maximum needle swing amount.

Also, in case the maximum value of the needle swing amount for the needle drop points of the sewing data is "7 mm", which exceeds the maximum needle swing amount of the sewing machine M shown in FIG. 3, which is "5 mm"; for example, as shown in FIG. 15, since every needle swing amount of the needle drop points are limited to the maximum needle swing amount ha, a width direction of the normal sewing pattern 40C is partially shortened compared to the original needle swing amount h. However, sewing of the sewing data, which otherwise could not have been sewn by the sewing machine M, is enabled by the modification.

Figure 16:
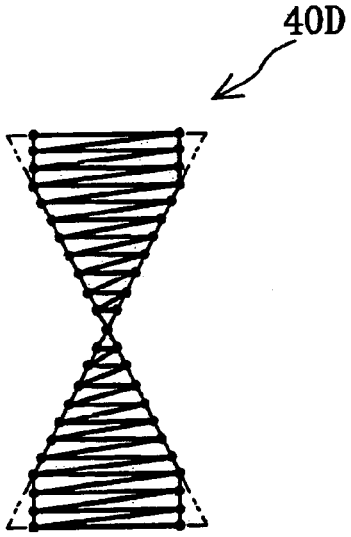
FIG. 16 is a descriptive figure of the normal sewing pattern in which the cloth feed pitch and the needle swing amount of the sewing data is limited by the maximum cloth feed pitch and the maximum needle swing amount.

Furthermore, in case the cloth feed pitch and the needle swing amount in the needle drop point of sewing data are both greater than the maximum cloth feed pitch and the maximum needle swing amount, as shown in FIG. 16, every cloth feed pitch and needle swing amount are limited to the maximum cloth feed pitch and the maximum needle swing amount. Hence, as if to reflect both FIGS. 14 and 15, the vertical direction of the normal sewing pattern 40D is shortened, and the width direction of the normal sewing pattern 40D is also partially shortened. However, sewing of the sewing data, which otherwise could not have been sewn by the sewing machine M, is enabled by the modification.

Now, the sewing device is configured by the needle bar driving mechanism, the needle bar swinging mechanism, the needle bar swing stepping motor 31, the feed dog longitudinally moving mechanism, the feed dog vertically moving mechanism, the lateral feeding mechanism and the feed dog drive stepping motor 32 etc.

As described above, according to the present embodiment example, the control device 15 determines the validity of the needle swing data relating to the basic sewing functions based on the maximum needle swing amount executable by the needle swing mechanism of the sewing device. As a result of the determination, in case needle swing data exceeds the executable maximum needle swing amount, since the modified sewing data limited by the maximum needle swing amount is created, by validating the data by limiting the required needle swing amount for sewing the pattern, the needle swing function of the sewing data is utilized to the possible extent.

Also, the validity of the cloth feed pitch data, related to the basic sewing functions included in the sewing data is determined based on the maximum cloth feed pitch executable by the cloth feeding mechanism of the sewing device. As a result of the determination, in case the cloth feed pitch data exceeds the executable maximum cloth feed pitch, since the modified sewing data limited by the maximum cloth feed pitch is created, by validating the data by limiting the cloth feed pitch required for sewing the pattern, the cloth feed function by the sewing data is utilized to the possible extent.

Also, the validity of the sewing speed data related to the basic sewing functions included in the sewing data is determined based on the maximum sewing speed of the sewing machine motor 30 of the sewing device. As a result of the determination, in case the sewing speed data exceeds the executable maximum sewing speed, since the modified sewing data limited by the maximum sewing speed is created, by validating the data by limiting the sewing speed required for sewing the pattern, the sewing speed function by the sewing data is utilized to the possible extent.

Also, the validity of automatic thread tension data and lateral feed data etc. related to the optional functions besides the basic sewing functions included in the sewing data is determined based on whether or not mechanisms to realize the optional functions provided in the sewing machine M exist or not.

Then, based on the determination result, in case the sewing machine M is not provided with an option realization mechanism corresponding to the optional function data, the modified sewing data with the optional function data deleted is created. Hence, even in case the optional functions cannot be realized, the sewing data can be utilized to the possible extent upon pattern sewing.

Also, in case the thread tension data exceeds the thread tension adjustment range executable by the automatic thread tension adjustment mechanism provided in the sewing machine M, the sewing data is modified to the executable thread tension adjustment range. In case the lateral feed data exceeds the maximum lateral feed pitch executable by the lateral feeding mechanism provided in the sewing machine M, the lateral feed data is modified to be limited to the executable lateral pitch. Thus, the sewing data can be utilized within the sewing capacity of the sewing machine M.

Furthermore, whether the sewing pattern can be fully displayed or not is determined by comparing the number of display dots in the vertical direction and the number of display dots in the lateral direction, composing the display data of the pattern with the number of pixels in the vertical direction and the number of pixels in the lateral direction included in the display pixels composing the display 10.

Depending upon the determination result, in case the number of display dots of the former exceeds the number of pixels of the later; since the pattern display data is modified to be displayed in the number of pixels, the sewing pattern is displayed to the possible maximum extent.

Also, whether color display of the sewing pattern is possible or not is determined by comparing the gradation range which can be displayed in color in the display 10 with the gradation data for color display of the display data of the pattern. If the determination result indicates that the gradation data exceeds the gradation range which can be displayed in color in the display 10, the display data is modified to be binarized corresponding to the black and white display. Hence, the color pattern display data can be displayed with black and white limitation.

The disclosure is not limited to the above embodiment example but can be transformed or expanded for example, as follows.

1) In case the gradation data for color display included in the pattern display data is greater than the gradation range which can be displayed in color, an upper and lower limit can be set for the greater gradation data and create a displayable pattern display data by making level adjustments that allocate the gradation data to a displayable gradation range.

2) In case the cloth feed pitch and needle swing amount included in the sewing data is greater than the maximum cloth feed pitch and the maximum needle sewing amount of the sewing machine M, a reduction ratio that reduces the maximum cloth feed pitch and the maximum needle swing amount of the sewing data to the latter maximum cloth feed pitch and maximum needle swing amount can be calculated and reduce each cloth feed pitch and needle swing value by the reduction ratio, that enables the sewing of the normal sewing pattern analogous to the original normal sewing pattern.

3) In case the lateral feed value included in the sewing data amounts to a multiple of the maximum lateral feed pitch of the sewing machine M owned by the user and in case a needle bar release mechanism is provided as an optional function to the sewing machine M, by actuating the needle bar release mechanism, the vertical movement of the needle bar can be stopped for plurality of stitches and execute plurality of consecutive lateral feed by the feed dog in the mean time.

4) In case the sewing machine M owned by the user is not provided with the automatic thread tension adjustment mechanism, and if a thread tension level to be set for automatic thread tension is included in the sewing data, the sewing sequence can be tentatively stopped a few stitches before the scheduled thread tension change. A message indicating the foregoing can be displayed in the display 10 such as "Please manually change the thread tension to "4"".

5) The sewing machine M can be connected to a personal computer and receive various pattern data supplied from external data transmitting network such as, for example, the internet via the personal computer.

6) Various image processing can be executed to enable the display of the pattern display data in case they are provided as various image data (for example, JPEG, GIF and TIFF etc.).

The foregoing description and drawings are merely illustrative of the principles of the present disclosure and are not to be construed in a limited sense. Various changes and modifications will become apparent to those of ordinary skill in the art. All such changes and modifications are seen to fall within the scope of the disclosure as defined by the appended claims.

We claim:

1. A sewing machine comprising:

a sewing device capable of pattern sewing by controlling a needle swinging mechanism that swings a vertically reciprocating needle bar in a horizontal direction and a cloth feeding mechanism having a feed dog;

a controller that controls the sewing device;

a memory that stores sewing data supplied externally via a data transmitting network or a data storage media;

wherein the controller determines whether or not a pattern to be sewn based on the sewing data loaded from the memory can be sewn by the sewing device based on a sewing function of the sewing machine, whereupon determining that sewing is not possible, the sewing data is modified to data of a pattern that can be sewn by the sewing device.

2. A sewing machine comprising:

a sewing device capable of pattern sewing by controlling a needle swinging mechanism that swings a vertically reciprocating needle bar in a horizontal direction and a cloth feeding mechanism having a feed dog;

a display;

a controller that controls the sewing device and the display;

a memory that stores pattern display data supplied externally via a data transmitting network or a data storage media; and the controller determines whether or not the pattern to be sewn based on the pattern display data loaded from the memory can be displayed in the display, whereupon determining that displaying is not possible, the pattern display data is modified to data of a pattern that can be displayed by the display.

3. A sewing machine according to claim 1, wherein the controller determines whether the pattern can be sewn or not by comparing needle swing data included in the sewing data and a maximum needle swing amount executable by the needle swinging mechanism of the sewing device.

4. A sewing machine according to claim 1, wherein the controller, determines whether the pattern can be sewn or not by comparing cloth feed pitch data included in the sewing data and a maximum cloth feed pitch executable by the cloth feeding mechanism of the sewing device.

5. A sewing machine according to claim 1, wherein, the controller determines whether the pattern can be sewn or not by comparing sewing speed data included in the sewing data and a maximum sewing speed of a sewing machine motor of the sewing device.

6. A sewing machine according to claim 1, wherein in case thread tension data is included in the sewing data, whether the pattern can be sewn or not is determined by comparing the thread tension data and a thread tension adjustment range adjustable by an automatic thread tension adjustment mechanism provided in the sewing device.

7. A sewing machine according to claim 1, wherein the controller, in case lateral feed data is included in the sewing data, determines whether the pattern can be sewn or not by comparing the lateral feed data and the maximum lateral feed pitch executable by a lateral feeding mechanism provided in the sewing device.

8. A sewing machine according to claim 3, wherein, the controller, in case the needle swing data exceeds a maximum needle swing amount, modifies the sewing data by limiting the sewing data to a maximum executable needle swing amount.

9. A sewing machine according to claim 4, wherein the controller, in case the cloth feed pitch data exceeds the maximum executable cloth feed pitch, modifies the sewing data by limiting the sewing data to the maximum executable cloth feed pitch.

10. A sewing machine according to claim 5, wherein, the controller, in case sewing speed data exceeds a maximum executable sewing speed, modifies the sewing data by limiting the sewing data to the maximum executable sewing speed.

11. A sewing machine according to claim 6, wherein, in case the sewing device is not provided with the automatic thread tension adjustment mechanism, a modification is made to delete the thread tension data from the sewing data.

12. A sewing machine according to claim 6, wherein, the controller, in case the thread tension data exceeds the thread tension adjustment range executable by the automatic thread tension adjustment mechanism, modifies the sewing data to an executable thread tension adjustment range.

13. A sewing machine according to claim 7, wherein, the controller, in case the sewing device is not provided with the lateral feeding mechanism, makes a modification to delete the lateral feed data from the sewing data.

14. A sewing machine according to claim 7, wherein, the controller, in case the lateral feed data exceeds the maximum lateral feed pitch executable by the lateral feeding mechanism, makes a modification so that the sewing data is limited to the executable lateral feed pitch.

15. A sewing machine according to claim 2, wherein, the controller determines whether the pattern can be displayed or not by comparing a number of display dots composing the pattern display data and a number of pixels composing the display.

16. A sewing machine according to claim 2, wherein, the controller determines whether the pattern can be displayed or not by comparing gradation data for color display included in the pattern display data and a gradation range displayable in color in the display.

17. A sewing machine according to claim 15, wherein, the controller, in case the number of display dots exceed the number of display pixels of the display, a data processing is carried out to make a modification so that the pattern display data can be displayed by the number of display pixels of the display.

18. A sewing machine according to claim 16, wherein, the controller, in case the gradation data exceeds the gradation range displayable in color, modifies the pattern display data into white and black data which can be displayed to the display by carrying out a binarizing data processing.

19. A sewing machine according to claim 1, provided with a display, wherein the controller, upon determining that the pattern cannot be sewn, displays such indication to the display.

20. A sewing machine according to claim 19, wherein, the controller, upon determining that the pattern can not be sewn, sets whether the sewing data is to be modified or not.

21. In a sewing machine provided with a sewing device capable of pattern sewing by controlling a needle swinging mechanism that swings a vertically reciprocating needle bar in a horizontal direction and a cloth feeding mechanism having a feed dog and a memory that stores sewing data supplied externally via a data transmitting network or a data storage media;

a computer program stored in a storage media readable by a computer composing the controller, wherein, the sewing data is loaded to the computer from the memory;

whether a pattern to be sewn based on the sewing data can be sewn by the sewing device or not is determined, whereupon determining that the sewing is not possible, the sewing data is modified to a pattern that can be sewn by the sewing device.

22. A computer program according to claim 21, wherein, whether the pattern can be sewn or not is determined by the computer by comparing needle swing data included in the sewing data and a maximum needle swing amount executable by the needle swinging mechanism of the sewing device.

23. A computer program according to claim 21, wherein, whether the pattern can be sewn or not is determined by the computer by comparing a cloth feed pitch included in the sewing data and a maximum cloth feed pitch executable by the cloth feeding mechanism of the sewing device.

24. A computer program according to claim 21, wherein, whether the pattern can be sewn or not is determined by the computer by comparing sewing speed data included in the sewing data and a maximum sewing speed of the sewing machine motor of the sewing device.

25. A sewing machine comprising:

a sewing device capable of pattern sewing by controlling a needle swinging mechanism that swings a vertically reciprocating needle bar in a horizontal direction and a cloth feeding mechanism having a feed dog;

a controller that controls the sewing device;

a memory that stores sewing data which is supplied externally via a data transmitting network or a data storage media and which includes at least data to control the needle swinging mechanism and/or the cloth feeding mechanism, to be used for controlling the sewing device; wherein the controller, in case the sewing data loaded from the memory includes data unusable by the sewing device, invalidates the unusable data which enables a partial invalidation of an original sewing data so that valid portions of the original sewing data can be used.

26. A sewing machine according to claim 25, wherein, the controller controls the sewing device based on valid data contained in the sewing data.

* * * * *